US009351577B2

(12) United States Patent
Rogers

(10) Patent No.: US 9,351,577 B2
(45) **Date of Patent: *May 31, 2016**

(54) CHAIR WITH CUSHION AND STACKABLE CONFIGURATION

(71) Applicant: Mity-Lite, Inc., Orem, UT (US)

(72) Inventor: Grant Rogers, Cedar Hills, UT (US)

(73) Assignee: Mity-Lite, Inc., Orem, UT (US)

( * ) Notice: Subject to any disclaimer, the term of this patent is extended or adjusted under 35 U.S.C. 154(b) by 193 days.

This patent is subject to a terminal disclaimer.

(21) Appl. No.: 14/075,141

(22) Filed: Nov. 8, 2013

(65) Prior Publication Data

US 2015/0130236 A1 May 14, 2015

(51) Int. Cl.

| | |
|---|---|
| ***A47C 3/04*** | (2006.01) |
| ***A47C 1/124*** | (2006.01) |
| ***A47C 3/00*** | (2006.01) |
| ***A47C 7/18*** | (2006.01) |

(52) U.S. Cl.
CPC . *A47C 3/04* (2013.01); *A47C 1/124* (2013.01); *A47C 7/185* (2013.01)

(58) Field of Classification Search
CPC ..... A47C 3/04; A47C 7/185; A47C 1/124
See application file for complete search history.

(56) References Cited

U.S. PATENT DOCUMENTS

| | | | | | |
|---|---|---|---|---|---|
| 1,674,220 | A * | 6/1928 | Percival | 297/440.22 | |
| 2,259,534 | A * | 10/1941 | Reynolds et al. | 267/81 | |
| 3,117,819 | A * | 1/1964 | Kudriavetz, Jr. | A47C 7/282 160/378 | |
| 3,455,605 | A * | 7/1969 | Anderson | 297/446.2 | |
| 3,639,001 | A * | 2/1972 | Anderson | 297/451.1 | |
| 3,981,534 | A * | 9/1976 | Wilton | 297/218.1 | |
| 4,978,168 | A * | 12/1990 | Piretti | 297/248 | |
| 5,282,669 | A * | 2/1994 | Barile | 297/248 | |
| 5,524,963 | A * | 6/1996 | Barile | 297/239 | |
| 5,632,524 | A * | 5/1997 | Ikeda | A47C 3/04 297/233 | |
| 5,954,396 | A * | 9/1999 | Kemnitzer | 297/248 | |
| 5,997,084 | A * | 12/1999 | Barile et al. | 297/239 | |
| 6,135,562 | A * | 10/2000 | Infanti | 297/440.2 | |
| 6,805,412 | B2 * | 10/2004 | Roth | A47C 7/44 297/239 | |
| 6,935,698 | B1 * | 8/2005 | Chen | 297/440.22 | |
| 7,654,617 | B2 * | 2/2010 | Farnsworth | 297/452.56 | |
| 8,511,753 | B2 * | 8/2013 | Huang | 297/440.22 | |
| 2009/0284057 | A1 * | 11/2009 | Kulish | A47C 3/04 297/239 | |

OTHER PUBLICATIONS

MODE, Human Scale, 4 Pages, accessed May 23, 2014.
The Vista Collection, Symmetry and Elegance, 6 Pages, accessed May 23, 2014.
Picture Perfect, MTS, 3 Pages,© 2011.
Banquet Chairs, MityLite, Grand Series, 2 Pages, Nov. 4, 2014.
MityLite, Grand Series, Banquet Chairs, 4 Pages, accessed Nov. 4, 2014.

* cited by examiner

*Primary Examiner* — David R Dunn
*Assistant Examiner* — Tania Abraham
(74) *Attorney, Agent, or Firm* — Thorpe, North & Western, LLP

(57) ABSTRACT

A chair has a frame with legs, a seat hoop carried by the legs, and a backrest extending above the seat hoop. A seat is carried by the seat hoop of the frame, and has a seat base with a cushion. A perimeter lip circumscribes the seat base and rests over the seat hoop. The seat base has a flexible and resilient corrugated interior capable of deflecting under weight and returning when the weight is removed. An annular bottom projection projects from the seat base between the perimeter lip and the corrugated interior and into the seat hoop, and has an annular bottom surface substantially flush with the lower surface of the seat hoop.

27 Claims, 8 Drawing Sheets

CHAIR WITH CUSHION AND STACKABLE CONFIGURATION

BACKGROUND

1. Field of the Invention

The present invention relates generally to chairs. More particularly, the present invention relates to stacking and/or banquet style chairs.

2. Related Art

Banquet type chairs are often used in multi-purpose rooms to provide various different configurations and numbers, and can be stacked for storage when not needed. In addition, such chairs can have a thick foam cushion for comfort for extended periods of sitting.

Another type of chair has been provided with a corrugated flexing arrangement. For example, see U.S. Pat. No. 7,654,617.

SUMMARY OF THE INVENTION

It has been recognized that it would be advantageous to develop a chair that provides both stacking and cushion capabilities. In addition, it has been recognized that it would be advantageous to develop a chair with a cushion that is stackable while resisting tipping due to the compression of the cushion. Furthermore, it has been recognized that it would be advantageous to develop a chair with a cushion that provides a fabric wrap.

The invention provides a chair having a frame with legs, a seat hoop carried by the legs, and a backrest extending above the seat hoop. The seat hoop has a thickness between upper and lower surfaces. A seat is carried by the seat hoop of the frame, and has a seat base with a cushion thereon. A perimeter lip circumscribes the seat base and rests over the seat hoop. A bottom projection projects from the seat base and into the seat hoop, and has a bottom surface substantially flush with the lower surface of the seat hoop.

In accordance with a more detailed aspect of the invention, the seat base can have a flexible and resilient corrugated interior capable of deflecting under weight and returning when the weight is removed. The bottom projection can be an annular bottom projection projecting from the seat base between the perimeter lip and the corrugated interior and into the seat hoop. The bottom surface can be an annular bottom surface substantially flush with the lower surface of the seat hoop.

In accordance with another more detailed aspect of the invention, the backrest can comprise a pair of elevated, open-ended tubes. A horizontal top bar can span the pair of tubes, and can have a pair of legs extending into open-ends of the pair of tubes. A dimple can be formed in the pair of tubes at the pair of legs to retain the pair of legs in the pair of tubes.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Figure 1:
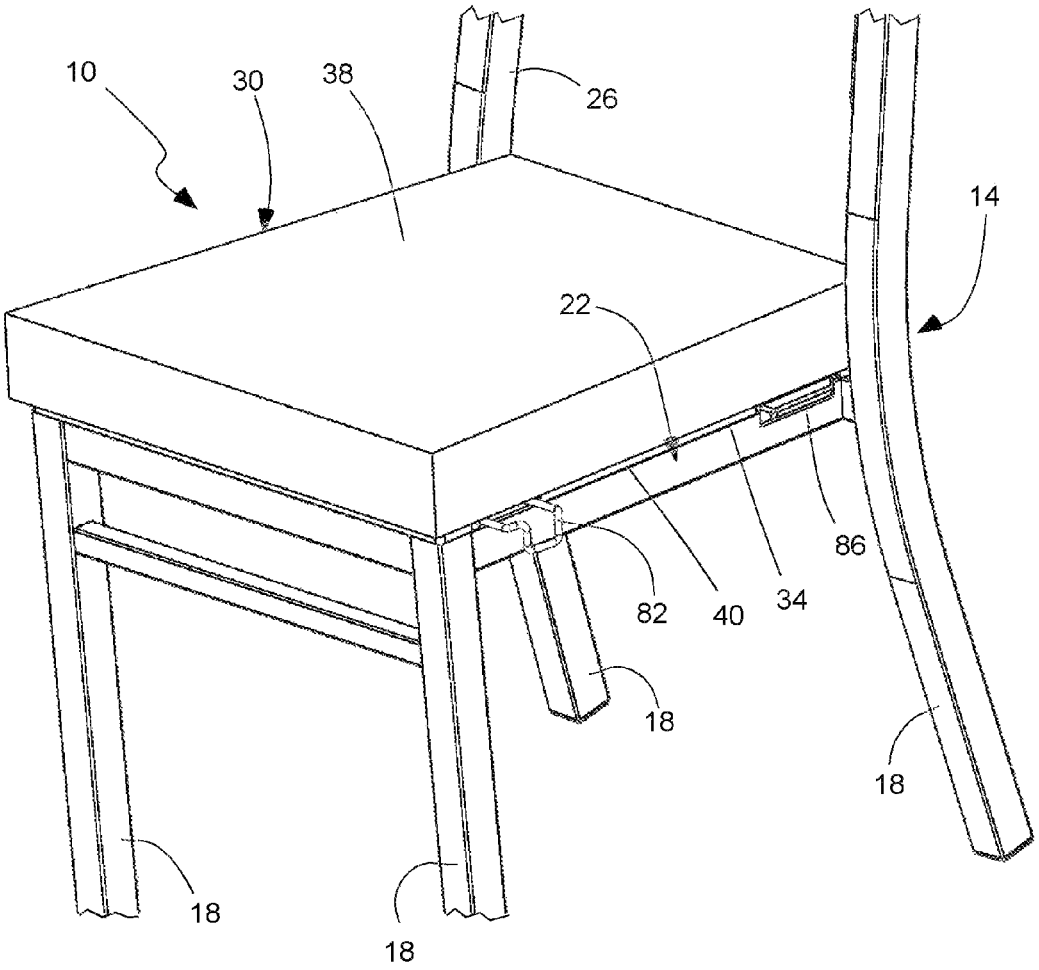
FIG. 1 is a partial perspective view of a chair in accordance with an embodiment of the present invention.
Figure 2:
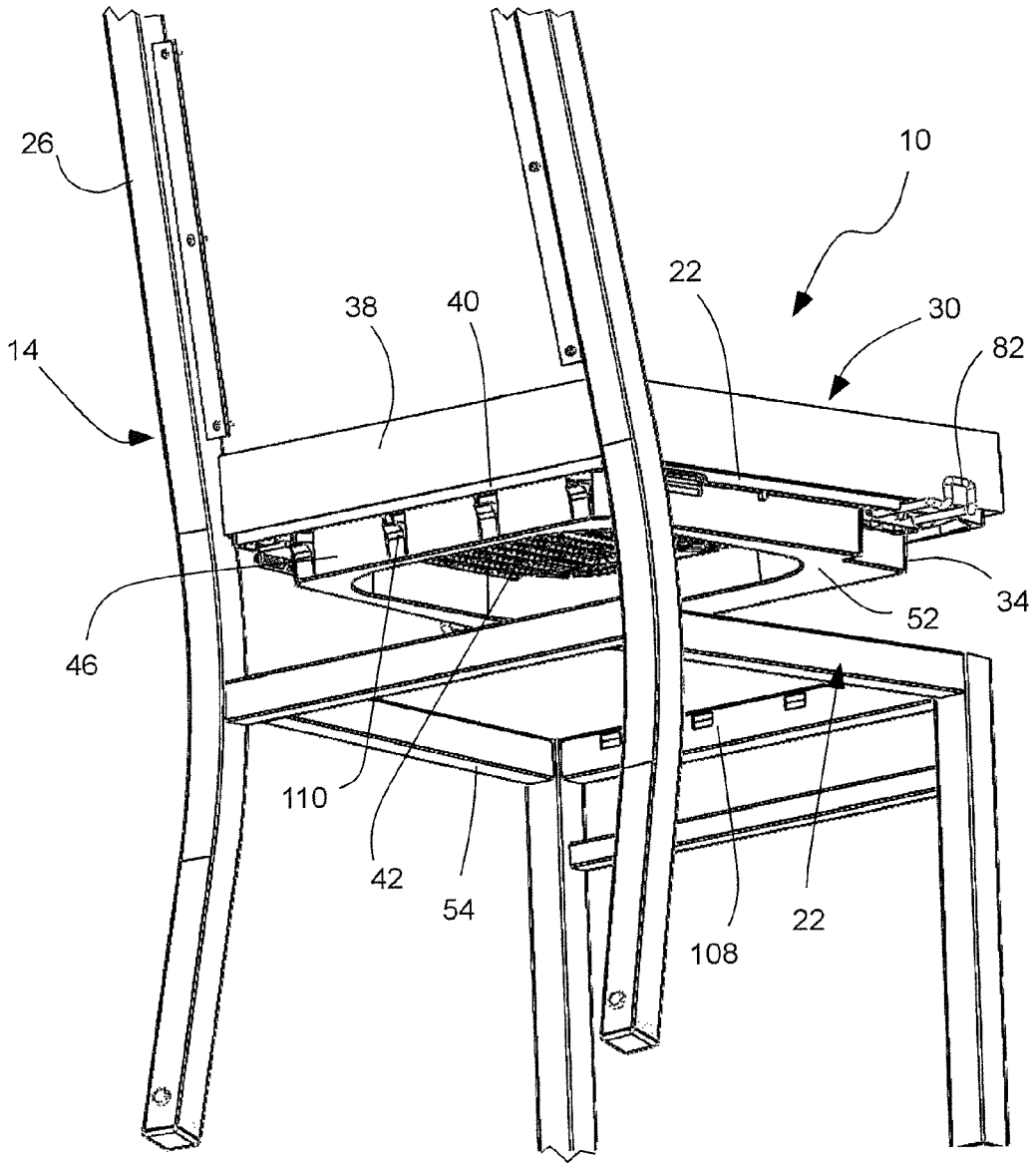
FIG. 2 is a partial exploded perspective view of the chair of FIG. 1.
Figure 3:
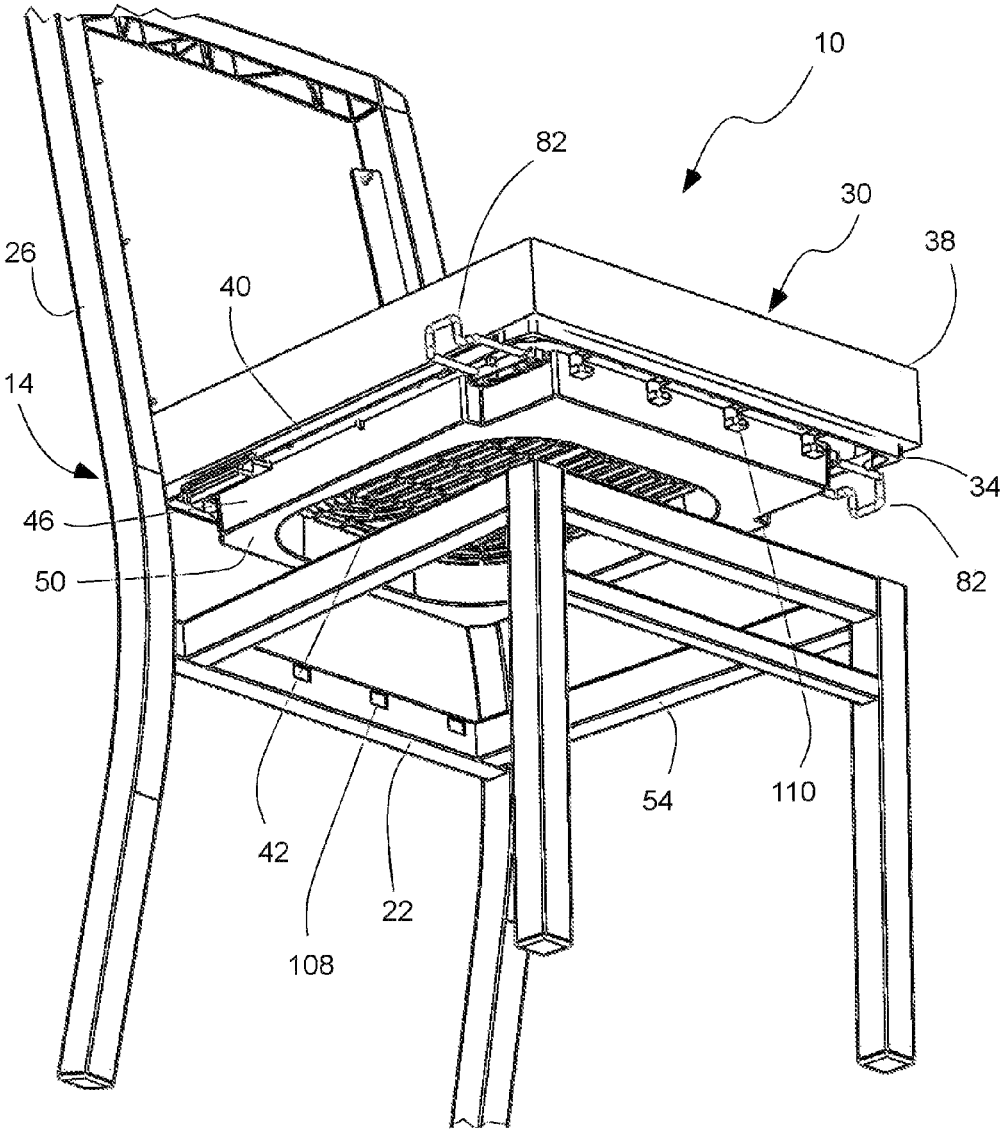
FIG. 3 is a partial exploded perspective view of the chair of FIG. 1.
Figure 4:
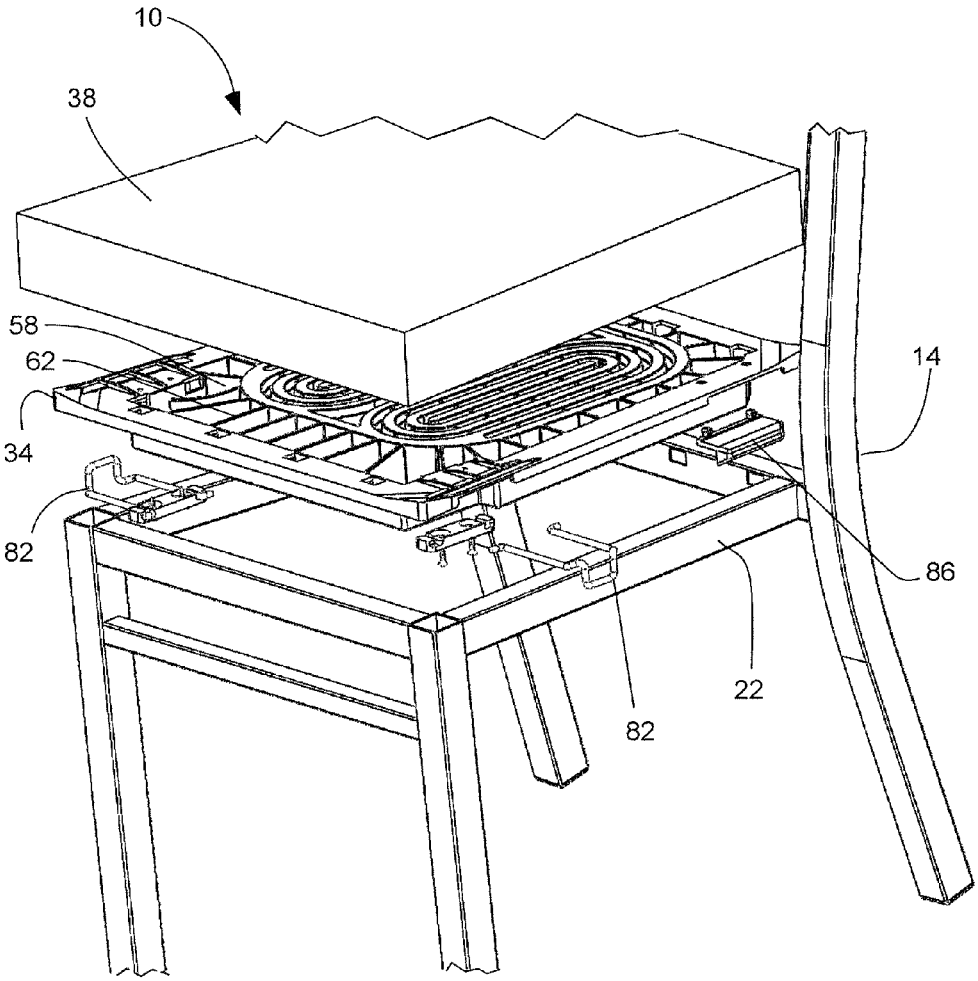
FIG. 4 is a partial exploded perspective view of the chair of FIG. 1.
Figure 5:
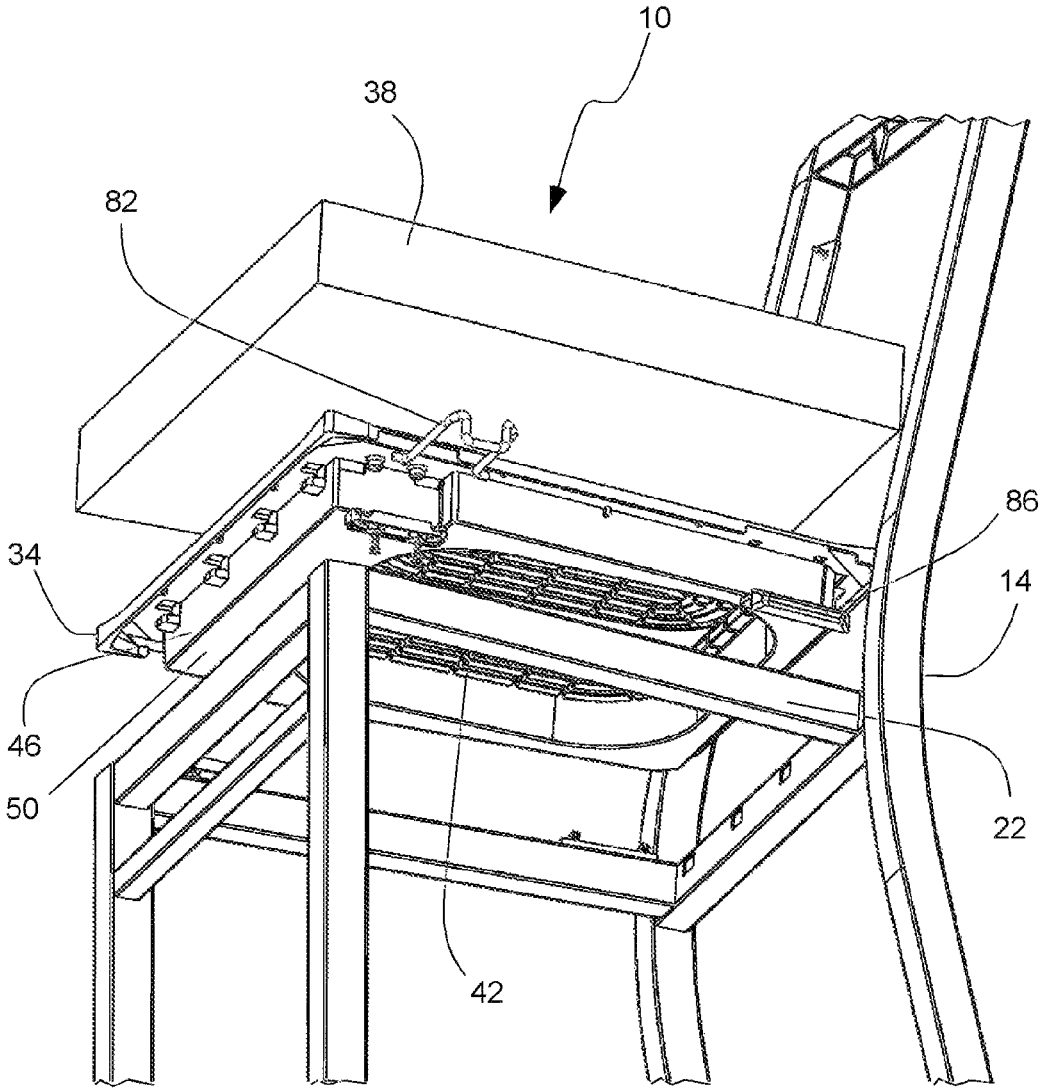
FIG. 5 is a partial exploded perspective view of the chair of FIG. 1.
Figure 6:
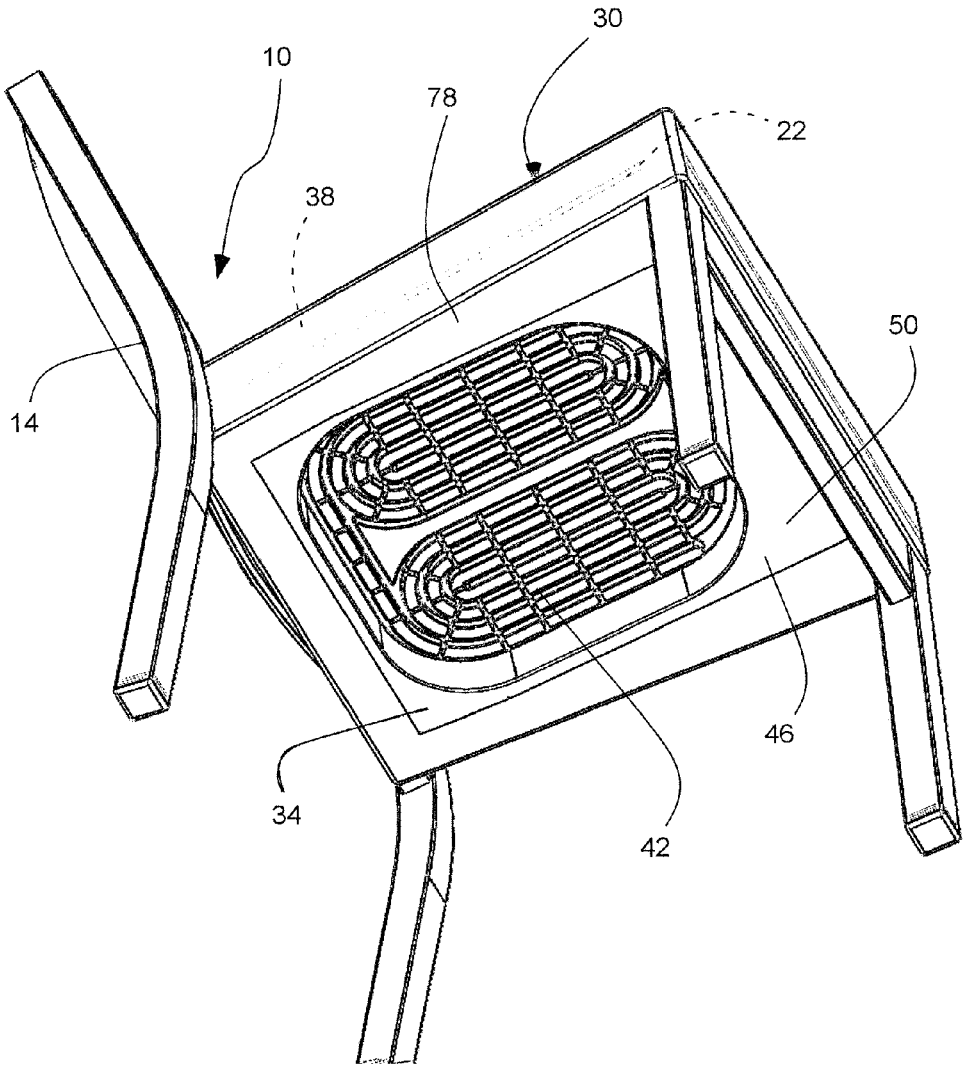
FIG. 6 is a partial bottom perspective view of the chair of FIG. 1.

In the Figures, a backrest panel of the backrest has been removed for illustrative purposes of the rest of the chair.

In some of the Figures, a cover layer of the seat has been removed to illustrate other components of the seat.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

As illustrated in FIG. 1-9, a chair, indicated generally at 10, in an example implementation in accordance with the invention is shown. The chair can be a banquet style chair that can be provided with a thick cushion, and configured to be stacked together for storage with at least another lower chair. In addition, the chair can include a ganging member to gang to an adjacent chair. In addition, the chair can have a fabric wrap over a seat, and the seat can be configured to facilitate the use of the fabric wrap and fastening the fabric wrap to the seat. Furthermore, the seat can have a top bar that can be coupled to open tubes of the chair.

The chair 10 has a frame 14 with a plurality of legs 18, such as four legs including a pair of front legs and a pair of rear legs. The legs can be oriented substantially vertically, and located in a generally square configuration. The rear legs can have an inward incline, such as an acute angle with respect to vertical, to facilitate stacking and/or nesting of the chair with another chair. In addition, the frame has a seat hoop 22 that is carried by and/or disposed atop the legs 18. Thus, the seat hoop can be disposed intermediate the frame, or between the legs and a backrest. The seat hoop can be oriented substantially horizontally, but can have a slight (or acute) incline with respect to horizontal for comfort. The seat hoop can be formed with, or partially by, the legs, with the legs forming corners of the seat hoop. Furthermore, the frame has a backrest 26 that extends above the seat hoop, and behind the seat hoop. The backrest can include or can be supported by backrest supports. The backrest supports can be formed by the rear legs extending above the seat hoop. The backrest supports and/or an upper portion of the rear legs above the seat hoop can be substantially vertical, but with a slight (or acute) outward incline or angle with respect to vertical, opposite that of the bottom portion of the rear legs, for comfort. Thus, the backrest supports and/or an upper portion of the rear legs above the seat hoop can form an obtuse angle with respect to the seat hoop (or seat) for comfort, and/or to facilitate stacking with another chair. The legs, seat hoop, and backrest support can be formed of tubes or tubing. The tubing can have a rectangular or square cross-sectional shape. The tubing can be metal, such as aluminum. The tubing of the legs and seat hoop can be welded together. The seat hoop can have front and rear spars coupled between the front and rear legs respectively; and lateral side spars coupled between the front and rear legs on opposite sides, to form the seat hoop, and to coupled the legs together. The seat hoop has a hoop thickness between upper and lower surfaces of the hoop, or the upper and lower surfaces of the tubing of the seat hoop.

A seat 30 is carried by the seat hoop 22 of the frame 14. The seat comprises a seat base 34 with a cushion 38. The cushion can be flexible and resilient. For example, the cushion can be or can include a block of foam. The seat base 34 can be relatively rigid compared to the cushion, and can be formed of plastic such as by injection molding, so that the seat base is formed as a single continuous monolithic body. The seat base 34 can have a perimeter lip 40 circumscribing the seat base and resting over the seat hoop 22. Thus, the seat base can span and cover the seat hoop or opening therein. In addition, the seat base 34 can have a flexible and resilient corrugated interior 42 capable of deflecting under weight and returning when the weight is removed. Thus, the structure of the seat base, although rigid, can be configured with ridges and channels to physically deflect under weight. Various aspects of the corrugated interior of the seat base are disclosed in U.S. Pat. No. 7,654,617, which is hereby incorporated herein by reference. The seat base 34 can provide support for the cushion 38 over the opening in the seat hoop. The cushion 38 and the corrugated interior 42 can together provide a comfortable, cushioned, support for the user to sit on.

The seat base or corrugated interior can have a number of accordion-like flex elements which interact under load to form a highly flexible seat member or platform, with a top surface that provides firm support to the cushion while simultaneously flexing to conform to the body shape of the user and reduce the number of pressure points. Although the flex elements can interact with each other in an intricate fashion, the seat base can be made from common, low-cost synthetic materials, such as plastic, polypropylene, polyethylene, nylon or equivalent polymer materials. This also allows for simple high-volume manufacturing techniques, such as injection molding, which can lead to economical and inexpensive production.

Formed in the interior portion of the seat base can be a pair of flex elements, or adjacent, corrugated regions which are disposed side-by-side and configured for flexibly supporting the buttocks of the user. The corrugated regions can further be defined as a series of alternating ribs and slots having rib tops and slot bottoms, and which can be connected by substantially vertical sidewalls. The rib tops can be co-planar with the top surface of the seat base in a non-flexed or unloaded condition, while the slot bottoms can be disposed below the seat surface.

The pair of adjacent, side-by-side corrugated regions can be surrounded by a third flex element or corrugated region, which is concentric with the interior pair and configured for flexibly supporting the hips and thighs of the user, and which can have similar alternating ribs and slots having rib tops and slot bottoms, and which can also be connected by substantially vertical sidewalls.

The pair of corrugated regions can each include a center bar which can define the center of the region, and which can align with the projected contact points of the buttocks of the user. The center bar can be a rib top. Alternatively, the center bar can be configured as a slot bottom to provide for more flexibility in the center and define a contact ring as providing the innermost contact point on the top surface. In like fashion, the transition rib or bar and associated triangular slots, which together bridge the gap between the pair of interior corrugated regions and the third surrounding corrugated region, can be reversed between rib tops or slot bottoms in an alternative aspect of the present invention. In other words, the transition bar can be configured as a transition slot, and the triangular slots can be likewise configured as triangular ribs.

A variety of alternating rib and slot configurations can be included within the scope of the present invention, to allow balancing of the degree of support versus the degree of elasticity provided by the pair of side-by-side corrugated regions and the third surrounding corrugated region, and to provide flexibility when fine-tuning the support and flexibility characteristics of the seat base. For instance, the width of the rib tops can be greater than the width of the slot bottoms, the ratio between the rib top width and slot bottom width can vary across the seat surface, or the depth of the slots can change between adjacent corrugations, etc.

The alternating ribs and slots in the corrugated regions can be configured to form a plurality of discrete rows. The discrete rows can be oblong or annular, and can form a series of complete rings. The rings can be further described as a series of complete interior rings concentric with the center bars of the interior pair of corrugated regions, and a series of complete exterior rings in the third concentric region that are concentric with the center of the seat base.

Figure 7:
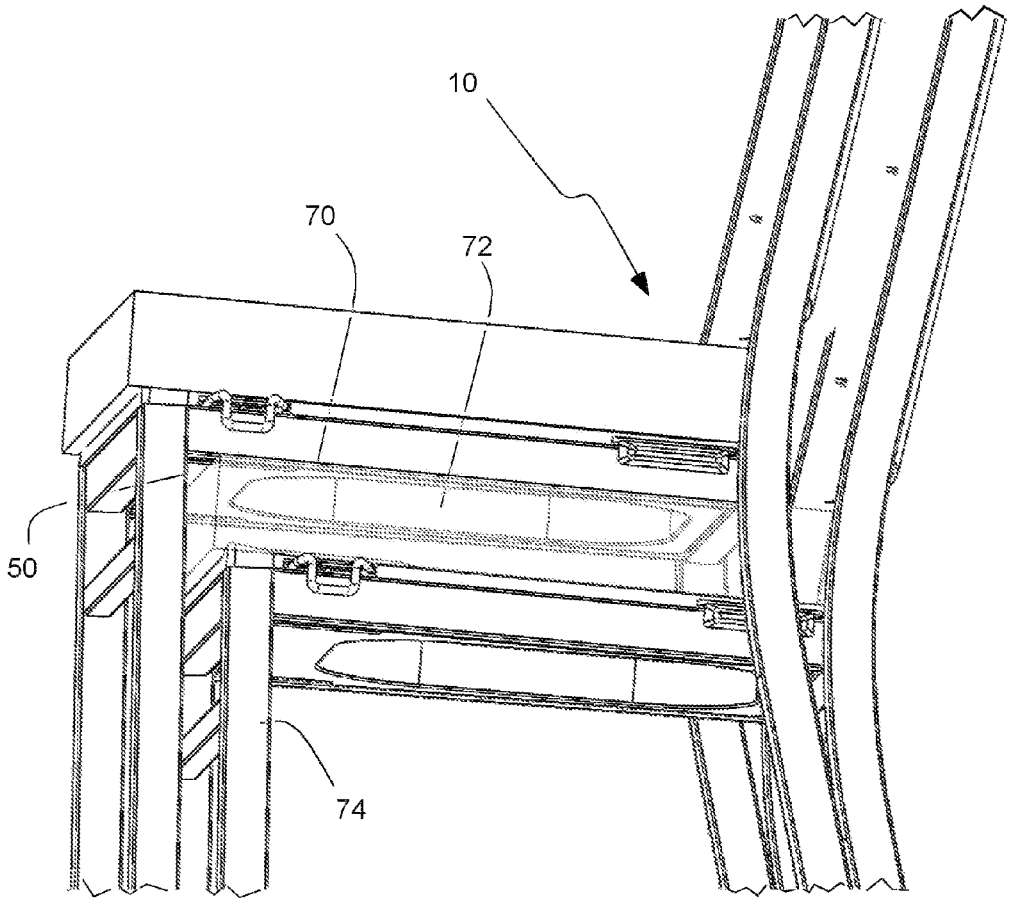
FIG. 7 is a partial side perspective view of the chair of FIG. 1, shown in a stacked configuration with a lower stacked chair.
Figure 8:
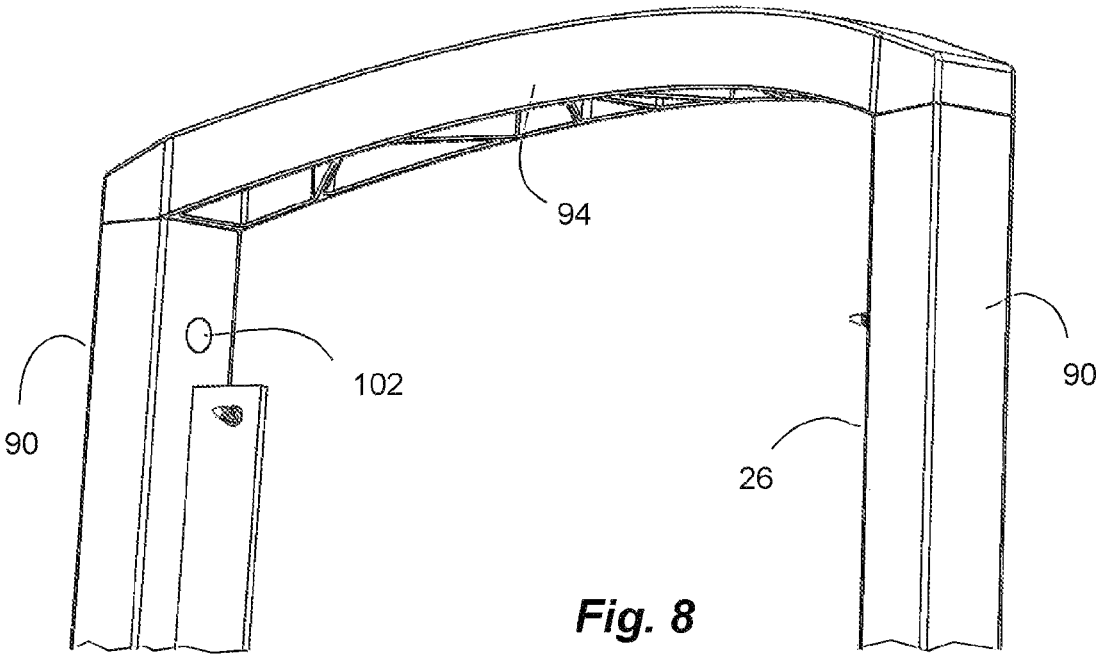
FIG. 8 is a partial perspective view of the chair of FIG. 1.
Figure 9:
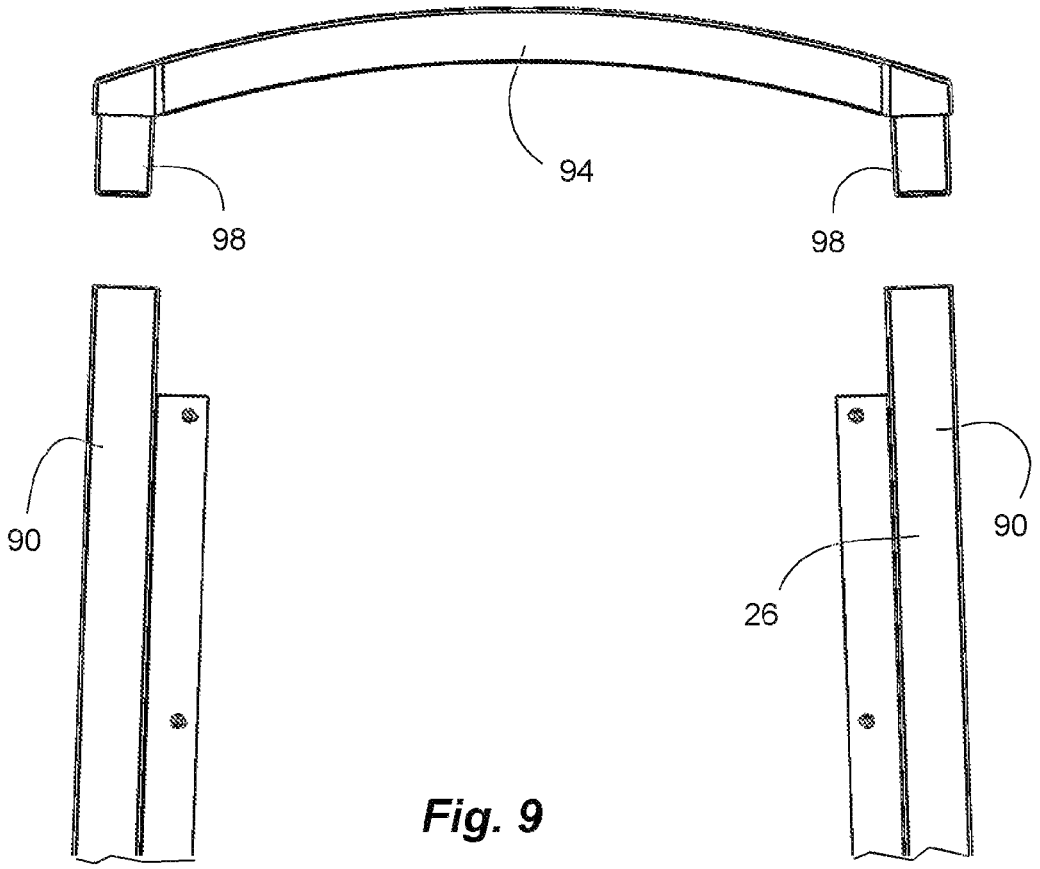
FIG. 9 is a partial exploded perspective view of the chair of FIG. 1.

In addition, the seat base 34 has a bottom projection 46 projecting from the seat base and into the seat hoop. The bottom projection can have a bottom surface 50 substantially flush with the lower surface 54 of the seat hoop. Thus, the seat hoop can provide the bottom surface thereof at the bottom of the seat hoop even though the seat base is disposed atop the seat hoop. The bottom projection can be an annular bottom projection projecting from the seat base between the perimeter lip 40 and the corrugated interior 42, and the bottom surface can be an annular bottom surface. The seat base 34 has a thickness greater than the seat hoop, and extends from the lower surface of the seat hoop to above the seat hoop. Thus, the seat base can provide the bottom surface while having the corrugated interior 42. The annular bottom projection can be formed by an annular groove 58 in the upper surface of the seat base between the perimeter lip and the corrugated interior, and corresponding to the annular bottom projection in the lower surface. The annular groove allows the annular bottom projection to be formed in the seat base as a single continuous monolithic piece. A plurality of radial fins 62 can be spaced-apart in the annular groove and oriented radially to extend between inner and outer walls of the annular groove. The fins can provide structural support. The annular bottom projection can substantially fill a lateral space between the seat hoop and the corrugated interior. Thus, the surface area of the bottom surface is maximized between the seat hoop and the corrugations. The bottom surface 50 of the seat base 34 is capable of abutting to a top 70 of a seat 72 of a lower chair 74 when stacked thereon to resist the seat hoop from sinking into the seat of the lower chair, as shown in FIG. 7.

In addition, the seat 30 can further comprise a cover layer 78 wrapped over the cushion 38 and the seat hoop 22, and fastened to the annular bottom surface 50 of the seat base. For example, the cover layer can include a fabric wrap, the edges of which can be stapled and/or adhered to the bottom surface of the seat base. Thus, the bottom surface 50 of the seat base and its location at a bottom of the seat hoop facilitates the addition of a cover layer, that can extend around the cushion, seat base, and seat hoop.

A ganging member, such as a ganging rod 82, can be affixed to the seat base 34 and can extend laterally beyond the seat hoop 22 between the perimeter lip 40 of the seat base and the seat hoop. The rod 82 can be bent in a U-shape, and can have free ends affixed to the seat base, horizontal arms resting over the seat hoop, and a closed end bent to extend vertically.

The free ends of the rod can be sandwiched between the seat base and a clip, with the clip secured to the seat base by fasteners, such as screws. The ganging member or rod can be capable of engaging another ganging member of an adjacent chair. The ganging member or rod, or portion thereof such as the horizontal arms, can be sandwiches between the seat base, or perimeter rim, and the seat hoop. Thus, the fasteners at the free ends, and the sandwich of the horizontal arms intermediate the rod, provides two points of attachment or support for the ganging member or rod.

In addition, a bumper 86 can be affixed to the seat base 34, and can extend laterally beyond the seat hoop between the perimeter lip of the seat base and the seat hoop. The bumper can be formed of a flexible or less rigid material than the plastic of the seat base and metal of the frame. The bumper can be snap-fit, or have snap fasteners, to attach to the seat base. Again, bumper can have two points of attachment or support, similar to the ganging member or rod. The bumper can abut to an adjacent chair or corresponding bumper of the adjacent chair.

As described above, the backrest can have a pair of backrest supports which can include a pair of elevated, open-ended tubes 90. The backrest can also include a horizontal top bar 94 spanning the pair of tubes. The top bar can have a pair of legs 98 that can extend into open-ends of the pair of tubes 90. The top bar can be formed by casting and can include a metal material, such as aluminum. A dimple 102 can be formed in the pair of tubes 90 at the pair of legs 98 to retain the pair of legs in the pair of tubes. The backrest can include a panel carried by and coupled to the backrest supports (but which is removed from the drawings for illustrative purposes).

The seat hoop 22 can have a plurality of holes 108 in an interior wall of the seat hoop. The seat base 34 can have a plurality of corresponding tabs 110 corresponding to the plurality of holes to retain the seat base to the seat hoop. The tabs on at least one side of the seat base can be angled, or have angled surfaces. Thus, the seat base can be press fit to the seat hoop without additional fasteners.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A chair device, comprising:

a) a frame having legs, a seat hoop carried by the legs, and a backrest extending above the seat hoop, the seat hoop having a thickness between upper and lower surfaces;

b) a seat carried by the seat hoop of the frame, and having a seat base with a cushion thereon;

c) the seat base having a perimeter lip circumscribing the seat base and resting over the seat hoop;

d) the seat base having a flexible and resilient corrugated interior capable of deflecting under weight and returning when the weight is removed;

e) the seat base having an annular bottom projection projecting from the seat base between the perimeter lip and the corrugated interior and into the seat hoop, and having an annular bottom surface substantially flush with the lower surface of the seat hoop; and f) a ganging member affixed to the seat base and extending laterally beyond the seat hoop between the perimeter lip of the seat base and the seat hoop, configured to engage another ganging member of an adjacent chair.

2. The chair device in accordance with claim 1, wherein the seat base is formed as a single continuous monolithic body.

3. The chair device in accordance with claim 1, wherein the seat base has a thickness greater than the seat hoop and extends from the lower surface of the seat hoop to above the seat hoop.

4. The chair device in accordance with claim 1, wherein the annular bottom projection substantially fills a space between the seat hoop and the corrugated interior.

5. The chair device in accordance with claim 1, wherein the annular bottom projection substantially extends around an interior of the seat hoop.

6. The chair device in accordance with claim 1, wherein the annular bottom surface of the seat base abuts to a top of a seat of a lower chair when stacked thereon to resist the seat hoop from sinking into the seat of the lower chair.

7. The chair device in accordance with claim 1, further comprising:

a cover layer wrapped over the cushion and the seat hoop and fastened to the annular bottom surface of the seat base.

8. The chair device in accordance with claim 1, wherein the ganging member further comprises:

a ganging rod affixed to the seat base and extending laterally beyond the seat hoop between the perimeter lip of the seat base and the seat hoop, configured to engage another ganging member of an adjacent chair, the rod bent in a U-shape and having free ends affixed to the seat base, horizontal arms resting over the seat hoop, and a closed end bent to extend vertically.

9. The chair device in accordance with claim 1, further comprising:

a bumper affixed to the seat base and extending laterally beyond the seat hoop between the perimeter lip of the seat base and the seat hoop, configured to abut to an adjacent chair or corresponding bumper of the adjacent chair.

10. The chair device in accordance with claim 1, further comprising:

the backrest comprising a pair of elevated, open-ended tubes;

a horizontal top bar spanning the pair of tubes and having a pair of legs extending into open-ends of the pair of tubes; and a dimple in the pair of tubes at the pair of legs to retain the pair of legs in the pair of tubes.

11. The chair device in accordance with claim 1, further comprising:

an annular groove in an upper surface of the seat base between the perimeter lip and the corrugated interior, and corresponding to the annular bottom projection in the lower surface.

12. The chair device in accordance with claim 11, further comprising:

a plurality of radial fins spaced-apart in the annular groove and oriented radially to extend between inner and outer walls of the annular groove.

13. The chair device in accordance with claim 1, further comprising:

a plurality of holes in an interior wall of the seat hoop; and a plurality of corresponding tabs in the seat base.

14. A chair device, comprising:

a) a frame having legs, a seat hoop carried by the legs, and a backrest extending above the seat hoop, the seat hoop formed of a tube and having a hoop thickness between upper and lower surfaces of the hoop;

b) a seat carried by the seat hoop of the frame, and having a seat base with a cushion thereon;

c) the seat base is formed as a single continuous monolithic body;

d) a perimeter lip circumscribing the seat base and resting over the seat hoop;

e) the seat base having a flexible and resilient corrugated interior capable of deflecting under weight and returning when the weight is removed;

f) an annular bottom projection projecting from the seat base between the perimeter lip and the corrugated interior and into the seat hoop, and having an annular bottom surface substantially flush with the lower surface of the seat hoop;

g) the seat base having a thickness greater than the seat hoop and extending from the lower surface of the seat hoop to above the seat hoop;

h) the annular bottom projection substantially filling a space between the seat hoop and the corrugated interior;

i) the annular bottom surface of the seat base capable of abutting to a top of a seat of a lower chair when stacked thereon to resist the seat hoop from sinking into the seat of the lower chair;

j) an annular groove in the upper surface of the seat base between the perimeter lip and the corrugated interior, and corresponding to the annular bottom projection in the lower surface;

k) a plurality of radial fins spaced-apart in the annular groove and oriented radially to extend between inner and outer walls of the annular groove;

l) a ganging rod affixed to the seat base and extending laterally beyond the seat hoop between the perimeter lip of the seat base and the seat hoop, capable of engaging another ganging member of an adjacent chair, the rod bent in a U-shape and having free ends affixed to the seat base, horizontal arms resting over the seat hoop, and a closed end bent to extend vertically.

15. The chair device in accordance with claim 14, further comprising:

a cover layer wrapped over the cushion and the seat hoop and fastened to the annular bottom surface of the seat base.

16. The chair device in accordance with claim 14, further comprising:

a bumper affixed to the seat base and extending laterally beyond the seat hoop between the perimeter lip of the seat base and the seat hoop, configured to abut to an adjacent chair or corresponding bumper of the adjacent chair.

17. The chair device in accordance with claim 14, further comprising:

the backrest comprising a pair of elevated, open-ended tubes;

a horizontal top bar spanning the pair of tubes and having a pair of legs extending into open-ends of the pair of tubes; and a dimple in the pair of tubes at the pair of legs to retain the pair of legs in the pair of tubes.

18. A chair device, comprising:

a) a frame having legs, a seat hoop carried by the legs, and a backrest extending above the seat hoop, the seat hoop having a thickness between upper and lower surfaces;

b) a seat carried by the seat hoop of the frame, and having a seat base with a cushion thereon;

c) a perimeter lip circumscribing the seat base and resting over the seat hoop;

d) a bottom projection projecting from the seat base and into the seat hoop, and having a bottom surface substantially flush with the lower surface of the seat hoop; and e) a ganging member affixed to the seat base and extending laterally beyond the seat hoop between the perimeter lip of the seat base and the seat hoop, configured to engage another ganging member of an adjacent chair.

19. The chair device in accordance with claim 18, further comprising:

the seat base having a flexible and resilient corrugated interior capable of deflecting under weight and returning when the weight is removed.

20. A chair device, comprising:

a) a frame having legs, a seat hoop carried by the legs, and a backrest extending above the seat hoop, the seat hoop having a thickness between upper and lower surfaces;

b) a seat carried by the seat hoop of the frame, and having a seat base with a cushion thereon;

c) a perimeter lip circumscribing the seat base and resting over the seat hoop;

d) a bottom projection projecting from the seat base and into the seat hoop, having a bottom surface substantially flush with the lower surface of the seat hoop; and e) a cover layer wrapped over the cushion and the seat hoop and fastened to the annular bottom surface of the seat base.

21. The chair device in accordance with claim 20, further comprising:

the seat base having a flexible and resilient corrugated interior capable of deflecting under weight and returning when the weight is removed; and the bottom projection being an annular bottom projection projecting from the seat base between the perimeter lip and the corrugated interior.

22. The chair device in accordance with claim 20, further comprising:

a ganging member affixed to the seat base and extending laterally beyond the seat hoop between the perimeter lip of the seat base and the seat hoop, configured to engage another ganging member of an adjacent chair.

23. The chair device in accordance with claim 20, further comprising:

a bumper affixed to the seat base and extending laterally beyond the seat hoop between the perimeter lip of the seat base and the seat hoop, configured to abut to an adjacent chair or corresponding bumper of the adjacent chair.

24. A chair device, comprising:

a) a frame having legs, a seat hoop carried by the legs, and a backrest extending above the seat hoop, the seat hoop having a thickness between upper and lower surfaces;

b) a seat carried by the seat hoop of the frame, and having a seat base with a cushion thereon;

c) a perimeter lip circumscribing the seat base and resting over the seat hoop;

d) a bottom projection projecting from the seat base and into the seat hoop, having a bottom surface substantially flush with the lower surface of the seat hoop; and e) a bumper affixed to the seat base and extending laterally beyond the seat hoop between the perimeter lip of the seat base and the seat hoop, configured to abut to an adjacent chair or corresponding bumper of the adjacent chair.

25. The chair device in accordance with claim 24, further comprising:

a cover layer wrapped over the cushion and the seat hoop and fastened to the bottom surface of the seat base.

26. The chair device in accordance with claim 24, further comprising:

the seat base having a flexible and resilient corrugated interior capable of deflecting under weight and returning when the weight is removed; and the bottom projection being an annular bottom projection projecting from the seat base between the perimeter lip and the corrugated interior.

27. The chair device in accordance with claim 24, further comprising:

a ganging member affixed to the seat base and extending laterally beyond the seat hoop between the perimeter lip of the seat base and the seat hoop, configured to engage another ganging member of an adjacent chair.

* * * * *